United States Patent [19]

Parks

[11] 4,105,894

[45] Aug. 8, 1978

[54] STEAM HEATED HOT AIR FURNACE HAVING AN ELECTRIC STEAM BOILER

[76] Inventor: John Allen Parks, 5932 Charlotte, Kansas City, Mo. 64110

[21] Appl. No.: 648,961

[22] Filed: Jan. 14, 1976

[51] Int. Cl.[2] ..... H05B 3/60; F24H 3/08; F22B 1/30; F24D 13/04

[52] U.S. Cl. ..... 219/365; 126/101; 165/105; 219/293; 219/341; 237/16; 126/101

[58] Field of Search ..... 219/284–295, 219/271–276, 341, 365, 326; 237/7, 16–18, 4; 165/105

[56] References Cited

U.S. PATENT DOCUMENTS

| | | | |
|---|---|---|---|
| 1,037,369 | 9/1912 | Thompson | 219/293 X |
| 1,848,627 | 3/1932 | Head | 219/288 UX |
| 1,866,221 | 7/1932 | Pennington | 219/341 |
| 1,887,533 | 11/1932 | Williams | 219/288 X |
| 2,041,116 | 5/1936 | De Kermor | 219/287 X |
| 2,041,573 | 5/1936 | Shapard | 219/365 |
| 2,430,347 | 11/1947 | Lamphier | 219/293 X |
| 2,522,373 | 9/1950 | Jodell | 219/341 UX |
| 2,538,648 | 1/1951 | Livingstone | 219/287 |
| 3,104,308 | 9/1963 | Wilson | 219/293 X |
| 3,140,824 | 7/1964 | Moore | 219/341 UX |
| 3,210,005 | 10/1965 | Arnold | 237/7 |
| 3,398,261 | 8/1968 | Mays | 219/293 X |

FOREIGN PATENT DOCUMENTS

| | | | |
|---|---|---|---|
| 462,315 | 11/1913 | France | 219/284 |
| 2,347,175 | 3/1974 | Fed. Rep. of Germany | 126/101 |
| 617,877 | 2/1949 | United Kingdom | 219/288 |

*Primary Examiner*—A. Bartis
*Attorney, Agent, or Firm*—Lowe, Kokjer, Kircher, Wharton & Bowman

[57] ABSTRACT

In a furnace having a boiler in which a pair of spaced electrode plates are supported, electric current is applied to the electrodes to generate steam which flows out of the boiler through a steam conduit to a heat exchanger. A blower forces air across the heat exchanger and out of the furnace through duct work for distribution to the rooms that are to be heated. An equalizer line is connected from the steam conduit to the bottom of the boiler. A return line, having a Hartford loop located above the bottom of the boiler but below the water level of the boiler, returns condensate from the heat exchanger to the boiler through the equalizer line.

6 Claims, 2 Drawing Figures

STEAM HEATED HOT AIR FURNACE HAVING AN ELECTRIC STEAM BOILER

BACKGROUND AND SUMMARY OF THE INVENTION

This invention relates generally to warm air furnaces and deals more particularly with a furnace that includes an electrically heated boiler.

Closed steam heating systems have long been used to heat homes and other buildings. Among the advantages of steam heating are its overall simplicity and reliability, while the disadvantages include radiator noise and the plumbing costs of the extensive piping that is required. In recent years, forced air furnaces have been considerably more popular than steam system, principally because of their quieter operation and reduced maintenance requirements. Since both types of heating systems are typically fired by coal, fuel oil or natural gas, they have been greatly affected by the recent cost increases in these shortage fuels.

A need therefore remains for an improved furnace which is able to heat effectively without consuming an excessive amount of fuel or power. It is the primary goal of the present invention to meet this need by providing a furnace that combines the simplicity and efficiency of steam heating with the advantages of forced air systems and electric furnaces.

An object of the invention is to provide a furnace of the character described in which the heat of the steam is transferred to circulating air for distribution to the rooms that are to be heated. The use of forced air in combination with a steam system retains the simplicity and efficiency of steam heating while eliminating the need for extensive piping and for radiators or the like in the rooms.

In summary, the invention is directed to an electric boiler furnace having an insulated boiler in which a pair of spaced electrodes are supported. Electric circuit applied to the electrodes generates steam which flows out of the boiler through a steam conduit to a heat exchanger. A blower forces air across the heat exchanger and out the furnace through duct work for distribution. An equalizer line is connected from the steam conduit to the bottom of the boiler. A return line, having a Hartford loop located above the bottom of the boiler but below the water level of the boiler, returns condensate from the heat exchanger to the boiler.

DETAILED DESCRIPTION OF THE INVENTION

Figure 1:
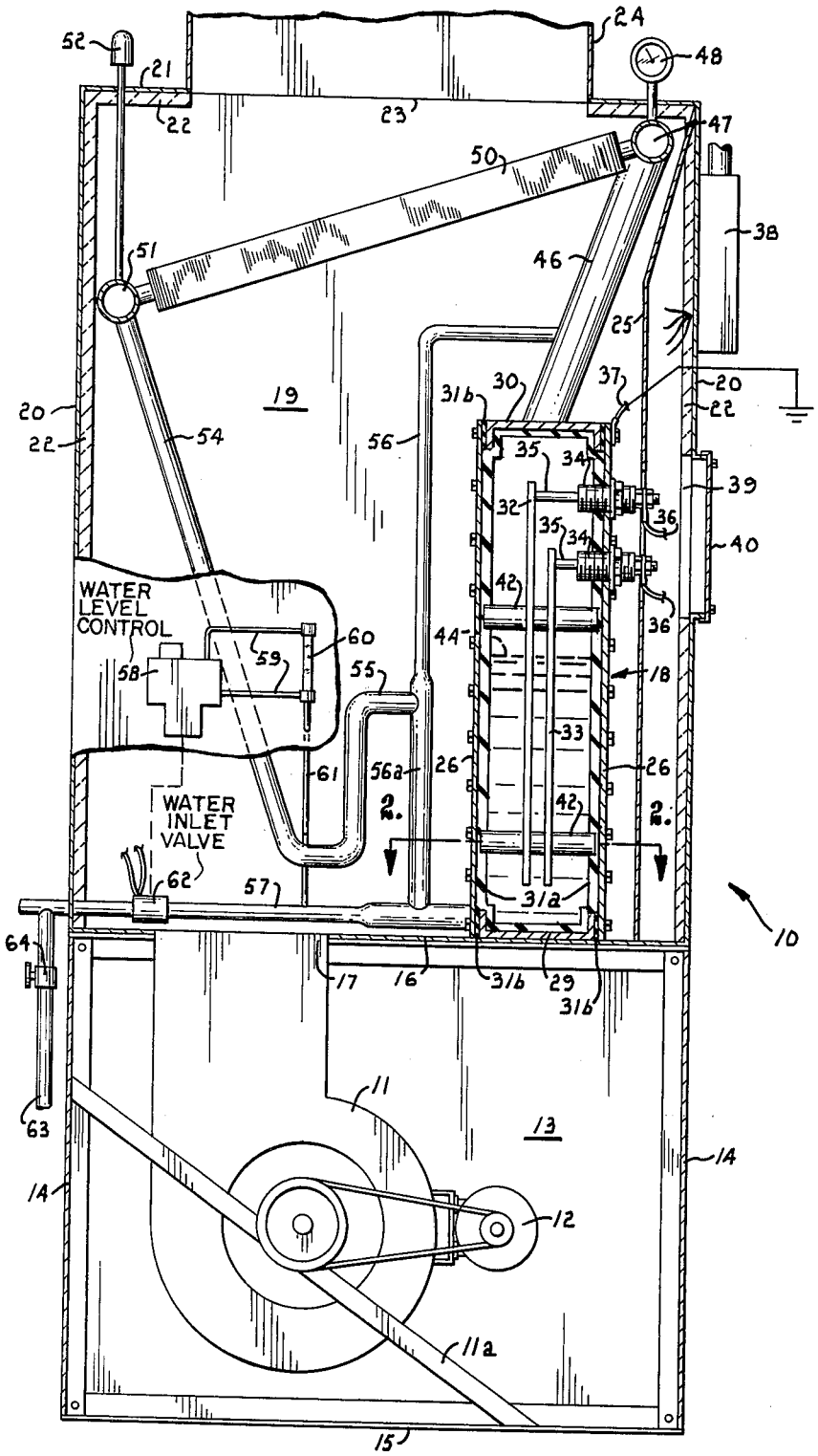
Figure 2:
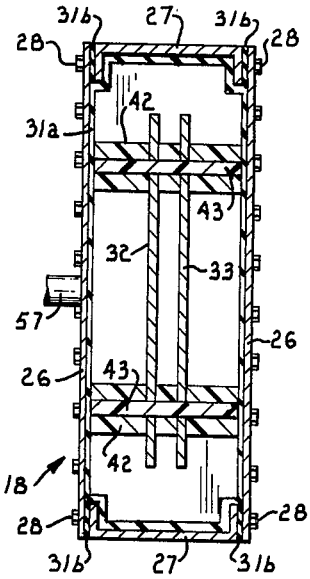

In the accompanying drawings which form a part of the specification and are to be read in conjunction therewith, and in which like reference numerals are employed to indicate like parts in the various views:

FIG. 1 is an elevational view in cross section taken through a furnace constructed in accordance with the present invention; and FIG. 2 is a fragmentary cross-sectional view taken generally along line 2—2 of FIG. 1 in the direction of the arrows.

Referring now to the drawing in detail, a furnace constructed according to the present invention is generally designated by reference numeral 10. A blower 11 is mounted on a support 11*a* and driven by a motor 12. Blower 11 and motor 12 are housed within a compartment 13 located at the bottom of the furnace housing. Compartment 13 is presented between walls 14, a floor

15, and an upper horizontal partition 16. An outlet opening 17 through which blower 11 discharges air is formed in partition 16.

A boiler 18 is located on top of partition 16 within the upper portion 19 of the furnace housing. Housing portion 19 is bounded by walls 20 and a ceiling 21 that are lined with thermal insulation 22. An outlet opening 23 is formed through ceiling 21, and a duct 24 connects to the outlet to receive and distribute warm air to the rooms that are to be heated. A generally vertical baffle 25 is mounted between one of the furnace walls 20 and the boiler 18 in order to assist in directing the air from blower 11 toward the outlet duct 24.

Referring now to FIG. 2 in particular, boiler 18 is rectangular in shape with opposite side walls 26 which comprise flat metal plates. The end walls 27 of the boiler are metal channels having flanges that are bolted at 28 to the side walls 26. The floor 29 and ceiling 30 of the boiler are also channels which are bolted to the end and side walls, as best shown in FIG. 1. The entire interior surface area of the boiler is lined with a coating of asbestos insulation 31*a*, and gaskets 31*b* are provided at the junctions between the boiler walls, floor and ceiling for sealing purposes.

A pair of electrodes 32 and 33 are located within boiler 18 in order to electrically heat the water therein. A pair of insulators 34 extend through one of the boiler side walls 26 in a leakproof manner. A conductor rod 35 extends through each insulator 34, and the electrodes 32 and 33 are connected to the ends of rods 35. Conductor wires 36 lead to conductors 35 in order to supply current thereto, while a ground wire 37 is grounded to the boiler. The wires lead to a panel 38 which is mounted to one of the furnace walls 20. An access opening 39 is formed through wall 20 and is normally covered by a door 40.

In the preferred embodiment, electrodes 32 and 33 are flat, rectangular stainless steel plates that are parallel to one another. Preferably, the electrode plates are approximately 3/16 inch thick and are spaced uniformly from one another a distance of about $\frac{5}{8}$ inch. Insulated spacers 42 are provided to maintain the uniform spacing and alignment of the electrodes 32 and 33. There are preferably a pair of spacers 42 near the lower ends of the electrodes and a second pair near the upper ends of the electrodes. As shown in FIG. 2, a rigid insulative rod 43 extends through each electrode 32 and 33 and between the boiler side walls 26, to which the rod is connected at its ends. The spacers 42 are supported around rods 43 and include central portions which are located between the electrodes 32 and 33 to maintain the spacing and alignment thereof. End portions of the spacers are located tightly between walls 26 and the electrode plates. Electrodes 32 and 33 are spaced well away from the walls, floor and ceiling of the boiler. Electrode 32 is somewhat greater in height than electrode 33, with its end located above that of electrode 33. The normal water level within boiler 18 is indicated at 44, and the top end of each electrode is located well above this level.

A steam conduit 46 connects to boiler 18 to receive the steam that is generated therein. Conduit 46 extends generally upwardly at an inclined angle from the top of the boiler and connects at its top end to a steam header pipe 47. The header pipe 47 extends generally horizontally and is preferably a copper pipe. A steam gauge 48 connects to pipe 47 and indicates the steam pressure therein.

A plurality of finned heat exchangers 50 extend at a slightly downwardly inclined angle from connection with header 47. Heat exchangers 50 are arranged to extend parallel to one another. Each heat exchanger 50 preferably comprises a coil of copper tubing having a diameter of approximately ½ inch. Each heat exchanger connects at its lower or left end to condensate return header pipe 51 which extends substantially horizontally and which receives the water that condenses on the heat exchangers. An air vent 52 vents to the atmosphere to permit the escape of air from pipe 51.

A return line 54 extends generally downwardly and inwardly toward boiler 18 from the return header 51. Line 54 is bent back upwardly at its lower portion and is connected with a Hartford loop 55, the horizontal portion of which is located approximately 2 inches below the water level line 44 in the boiler. The Hartford loop 55 connects at its end with an equalizer line 56 which extends upwardly and is then bent horizontally to connect with the steam conduit 46 at a location above the boiler. The condensate return path includes a downward continuation 56*a* of the equalizer line which extends from the Hartford loop 55 downwardly to connection with a horizontal fill line 57. Line 57 connects with the bottom portion of the boiler to supply fresh water and condensate thereto.

An automatic fill mechanism for supplying water to the boiler includes a casing 58 from which a pair of generally horizontal pipes 59 extend. A vertical gauge glass 60 is connected between the ends of lines 59 and serves to visually indicate the water level in the boiler. A vertical pipe 61 extends upwardly from the fill pipe 57 to connect same with the automatic fill mechanism. A float valve (not shown) within casing 58 operates a valve 62 in the fill line 57 when the water level in the casing drops below a preselected level. When this occurs, valve 62 admits water to the boiler through line 57 which connects to a water supply. A drain pipe 63 equipped with a manual valve 64 connects to an intermediate portion of pipe 57.

In use, a conventional room thermostat (not shown) controls blower 11 and the current supply to conductor rods 35. When current is applied to electrodes 32 and 33 to create a voltage differential therebetween, the electrical charge flows through the water between the electrodes, and the water is thereby heated to quickly reach the boiling temperature. The steam that is generated in the boiler passes through steam pipe 46 and into the header pipe 47. The steam then flows through the heat exchangers 50 in equal amounts, and the action of blower 11 forces a flow of air across the heat exchangers. The baffle 25 assists in directing the air toward the heat exchangers and the outlet duct 24. The air that flows past heat exchangers 50 picks up heat from the steam therein, and the warm air passes out through duct 24 and is distributed to the rooms that are to be heated.

The water that condenses in heat exchangers 50 flows along the length thereof into the return header pipe 51. From pipe 51, the condensate flows through pipe 54 and the Hartford loop 55 back into the boiler through line 56*a* and the fill line 57. The Hartford loop acts essentially to trap water since it is located below the water level of the boiler. The equalizer line 56 applies downward steam pressure at the bottom portion of the boiler and thus cooperates with the Hartford loop to prevent a backflow of steam from the boiler. It is contemplated that suitable automatic switch controls (not shown) will shut off current to electrodes 32 and 33 if the water level in the boiler is too low or if the boiler floods, and also if blower 11 should malfunction.

It has been found that the electrical energy applied to the electrodes is converted into heat for boiling the water. As an example of the efficiencies that have been obtained, 40 kilowatts were consumed in a typical 24 hour period during which the furnace maintained the average size house in which it was installed at a temperature of 73° F. The outside temperature varied between 38° F and 64° F during the 24 hours. During another typical 24 hour period in which the outside temperature varied between 50° F and 60° F, the house was maintained at 73° F with the furnace consuming 30 kilowatts of power.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A furnace comprising:

a furnace housing having an air inlet;

a boiler located within said housing for containing water;

water level control means for maintaining a predetermined water level within said boiler;

electrical insulation coating the entire inside surfaces of said boiler;

a single pair of electrodes supported within said boiler in spaced relation;

means for applying a voltage differential between said electrodes to effect heating of water in said boiler to the boiling point;

a steam conduit in said housing extending from the top of said boiler to receive steam therefrom;

a heat exchanger in said housing coupled to said steam conduit to receive steam therefrom;

blower means in said housing for forcing a flow of air past said heat exchanger to heat the flowing air by heat exchange with the steam in said steam conduit;

an outlet duct from said housing to direct the heated air out of the housing;

an equalizer line having upper and lower ends, said upper end connected to said steam conduit at the top of said boiler and said lower end connected to said boiler near the bottom thereof;

a Hartford loop located remote from said boiler and being, in vertical elevation, located above the bottom of said boiler but below the water level within the boiler, said Hartford loop having one end connected to said equalizer line intermediate the upper and lower ends thereof; and a condensate return line interconnecting said heat exchanger and the other end of said Hartford loop whereby condensate from the heat exchanger flows through said return line and through said Hartford loop to said equalizer line for return to said boiler.

2. A furnace as set forth in claim 1, wherein each of said electrodes comprises a conductive plate, said plates being spaced substantially uniformly apart in parallel relation.

3. A furnace as set forth in claim 2, including electrically insulative spacers for maintaining the uniform spacing between said plates.

4. A furnace as set forth in claim 3, wherein each spacer includes a rigid electrical insulator extending through each of said plates between opposed walls of said boiler.

5. A furnace as set forth in claim 1, including a baffle supported within said housing at a location to assist in directing the air from said blower toward said heat exchanger.

6. A furnace as set forth in claim 1, wherein said blower means is located below said heat exchanger to direct air upwardly theretoward, said outlet duct being located above said heat exchanger.

* * * * *